US006836991B1

(12) United States Patent
Saur

(10) Patent No.: US 6,836,991 B1
(45) Date of Patent: Jan. 4, 2005

(54) SYSTEM AND METHOD FOR A CARTRIDGE CASING CATCHER

(76) Inventor: Thomas W. Saur, 1932 Chestnut, Dearborn, MI (US) 48124-4312

( * ) Notice: Subject to any disclaimer, the term of this patent is extended or adjusted under 35 U.S.C. 154(b) by 0 days.

(21) Appl. No.: 10/674,599

(22) Filed: Oct. 1, 2003

(51) Int. Cl.[7] ..... F41A 15/16

(52) U.S. Cl. ..... 42/98; 89/14.05; 89/14.4; 89/33.01; 89/33.02; 181/223

(58) Field of Search ..... 42/98; 89/14.05, 89/14.4, 33.01, 33.02; 181/223

(56) References Cited

U.S. PATENT DOCUMENTS

| | | | | | |
|---|---|---|---|---|---|
| 1,018,720 | A | | 2/1912 | Maxim | |
| 1,027,509 | A | * | 5/1912 | Smiley | 42/106 |
| 1,201,189 | A | * | 10/1916 | Johnson | 224/0.5 |
| 1,229,675 | A | | 6/1917 | Thompson | |
| 2,866,289 | A | * | 12/1958 | Wilcox | 42/87 |
| 3,153,981 | A | * | 10/1964 | Brass | 89/33.4 |
| 3,156,991 | A | * | 11/1964 | Adams | 42/98 |
| 3,609,900 | A | * | 10/1971 | Bernocco | 42/98 |
| 3,618,458 | A | * | 11/1971 | Pruonto et al. | 89/33.4 |
| 3,739,685 | A | * | 6/1973 | Lundgren | 89/33.4 |
| 4,020,738 | A | * | 5/1977 | Martinez | 89/33.4 |
| 4,166,333 | A | | 9/1979 | Kratzer | |
| 4,204,353 | A | * | 5/1980 | Isola | 42/98 |
| 4,334,375 | A | * | 6/1982 | Olson | 42/98 |
| 4,430,820 | A | * | 2/1984 | Marsh | 42/98 |
| 4,594,803 | A | * | 6/1986 | Muncy | 42/98 |
| 4,903,426 | A | * | 2/1990 | Bammate | 42/98 |
| 4,959,918 | A | * | 10/1990 | Perez | 42/98 |
| 5,033,356 | A | | 7/1991 | Richardson | |
| 5,138,787 | A | * | 8/1992 | Riddle et al. | 42/98 |
| 5,285,593 | A | * | 2/1994 | Bammate | 42/98 |
| 5,398,439 | A | * | 3/1995 | Harless | 42/98 |
| 5,651,208 | A | * | 7/1997 | Benson | 42/98 |
| 5,934,002 | A | * | 8/1999 | Blanchet | 42/98 |
| 6,173,520 | B1 | * | 1/2001 | Bucciarelli et al. | 42/98 |
| 6,487,808 | B1 | * | 12/2002 | Carey | 42/98 |
| 6,530,169 | B1 | * | 3/2003 | Griffin | 42/98 |

OTHER PUBLICATIONS

Website: www.bushmaster.com/shopping/accessories/el–ar–∞2.asp (dated May 7, 2003), p. 1 of 1.
Website: www.gunblast.com/3Bucc Brass Catcher.htm (dated May 7, 2003), pp. 1–4.
Website: http://remtek.com/arms/steyr/aug/access/catcher.htm (dated May 7, 2003), pp. 1–2.

* cited by examiner

*Primary Examiner*—Michael J. Carone
*Assistant Examiner*—John Richardson

(57) ABSTRACT

A catcher for receiving expended shell casings from a firearm having an ejection port as the firearm is discharged, the catcher includes a hollow housing and a lining. The hollow housing having a plurality of rigid walls, wherein one of the walls has an opening in communication with the ejection port when the catcher is mounted to the firearm for receiving the shell casings. The lining is fixed inside the rigid walls, wherein the lining includes an acoustic foam having a plurality of wedges and the wedges are configured to deflect the shell casings into the catcher.

8 Claims, 2 Drawing Sheets

SYSTEM AND METHOD FOR A CARTRIDGE CASING CATCHER

BACKGROUND OF THE INVENTION

1. Field of the Invention

The present invention relates to a system and a method for a firearm cartridge casing catcher.

2. Background Art

Cartridge casing catchers are mounted adjacent the ejection port of a firearm to catch the spent cartridge casings (so-called "brass") as the casings are ejected after a round is fired. The brass is generally collected for reloading and to prevent casings from being underfoot which can cause a shooter or observer unstable shooting or movement. The brass may also be collected by a cartridge casing catcher to reduce the evidence left at the shooting site and to reduce the noise generated during the shooting by eliminating the noise generated when the casing impacts the surface (i.e., floor, roof, etc.) where the shooter (i.e., firearm user) is positioned. An example of a conventional spent shell container is shown in U.S. Pat. No. 4,166,333 to Kratzer (Kratzer '333).

Conventional brass catchers such as shown in the Kratzer '333 patent may have a deficiency in that spent cartridges are ejected with a significant force and tend to bounce inside the collection chamber and in some instances, the spent cartridge can bounce back into the firearm ejection port causing the firearm to jam. Such a jam is highly undesirable when the firearm user is involved in a critical mission situation.

Conventional brass catchers such as shown in the Kratzer '333 patent may have additional deficiencies in that the spent cartridges tend to rattle in the collection chamber and thus cause additional undesirable noise, and the impact of the spent cartridge one the sides and bottom of the catcher can cause a drumming of the conventional catcher structure and radiation of the corresponding noise.

The muzzle report of blow back operated and closed breech firearms may be reduced by the installation of a so-called "silencer" (more properly called a suppressor) on the muzzle, integral with the barrel of the firearm, or both on the muzzle and integral with the barrel. Examples of conventional firearms suppressors are shown in U.S. Pat. No. 5,033,356 to Richardson, U.S. Pat. No. 1,018,720 to Maxim, and U.S. Pat. No. 1,229,675 to Thompson. However, significant noise and flash (i.e., blast) are generated and expelled at the breech of the firearm, especially for open-bolt (or blowback) firearms, and from a closed breech weapon to an extent which can be unacceptable for clandestine operations. For example, weapons such as the Heckler & Koch Model HK MP5SD, while having very low muzzle report, still produce noise and flash from the ejection port which presents a blast that may be significant and unacceptable in some situations and open bolt weapons such as the Ingram—10, even when equipped with a muzzle suppressor, still can produce noise (as well as flash) from the breech that is at a level such that the user advisably wears ear protection to reduce the likelihood of hearing loss. Conventional brass catchers such as shown in the Kratzer '333 patent and especially bag type brass catchers may provide some flash reduction but provide very little reduction of the noise emitted at the firearm port.

Thus, there exists a need and an opportunity for an improved system and an improved method for a cartridge casing catcher. Such an improved system and an improved method for a cartridge casing catcher may provide reduced or eliminated bouncing of the spent cartridges back into the firearm ejection port and so reduce or eliminate jamming caused by the spent cartridges bouncing back, reduced or eliminated noise and flash from a firearm ejection port, reduced or eliminated rattle of collected brass, and reduced or eliminated brass catcher structure drumming.

SUMMARY OF THE INVENTION

Accordingly, the present invention may provide an improved system and method for a cartridge casing catcher. Such an improved system and an improved method for a cartridge casing catcher may provide reduced or eliminated bouncing of the spent cartridges back into the firearm ejection port and so reduce or eliminate jamming caused by the spent cartridges bouncing back, reduced or eliminated noise and flash from a firearm ejection port, reduced or eliminated rattle of collected brass, and reduced or eliminated brass catcher structure drumming when compared to conventional approaches.

According to the present invention, a catcher for receiving expended shell casings from a firearm having an ejection port as the firearm is discharged is provided. The catcher includes a hollow housing and a lining. The hollow housing having a plurality of rigid walls, wherein one of the walls has an opening in communication with the ejection port when the catcher is mounted to the firearm for receiving the shell casings. The lining is fixed inside the rigid walls, wherein the lining includes an acoustic foam having a plurality of wedges and the wedges are configured to deflect the shell casings into the catcher.

Also according to the present invention, a method of reducing jamming of a firearm as a spend cartridge is ejected from and ejection port into a cartridge casing catcher when the firearm is discharged is provided. The method comprises providing a hollow housing having a plurality of rigid walls, wherein one of the walls has an opening in communication with the ejection port when the catcher is mounted to the firearm for receiving the shell casings, and fixing a lining inside the rigid walls, wherein the lining comprises an acoustic foam having a plurality of wedges and the wedges are configured to deflect the shell casings into the catcher.

Still further according to the present invention, a lining for a catcher for receiving expended shell casings from a firearm having an ejection port as the firearm is discharged is provided. The catcher is a hollow housing having a plurality of rigid walls, and one of the walls has an opening in communication with the ejection port when the catcher is mounted to the firearm for receiving the shell casings. The liner comprises an acoustic foam having a plurality of wedges and the wedges are configured to deflect the shell casings into the catcher.

The above features, and other features and advantages of the present invention are readily apparent from the following detailed descriptions thereof when taken in connection with the accompanying drawings.

DETAILED DESCRIPTION OF THE PREFERRED EMBODIMENT(S)

With reference to the Figures, the preferred embodiments of the present invention will now be described in detail. Generally, the present invention provides an improved system and method for a cartridge casing catcher (i.e., a "brass catcher"). The cartridge casing catcher of the present invention is generally mounted (i.e., fastened, fixed, attached, etc.) adjacent to and covering (i.e., over, in communication with, etc.) an ejection port of a semi-automatic or full-automatic firearm. In one example, the present invention may be advantageously mounted to the firearm via an apparatus similar to the mounting shown in U.S. Pat. No. 4,166,333 to Kratzer (hereinafter Kratzer '333), which is incorporated herein by reference in its entirety. In another example, the brass catcher of the present invention may be mounted via a clamping mechanism. However, the present invention may be mounted to the firearm where implemented via any appropriate apparatus to meet the design criteria of a particular application.

Figure 1:
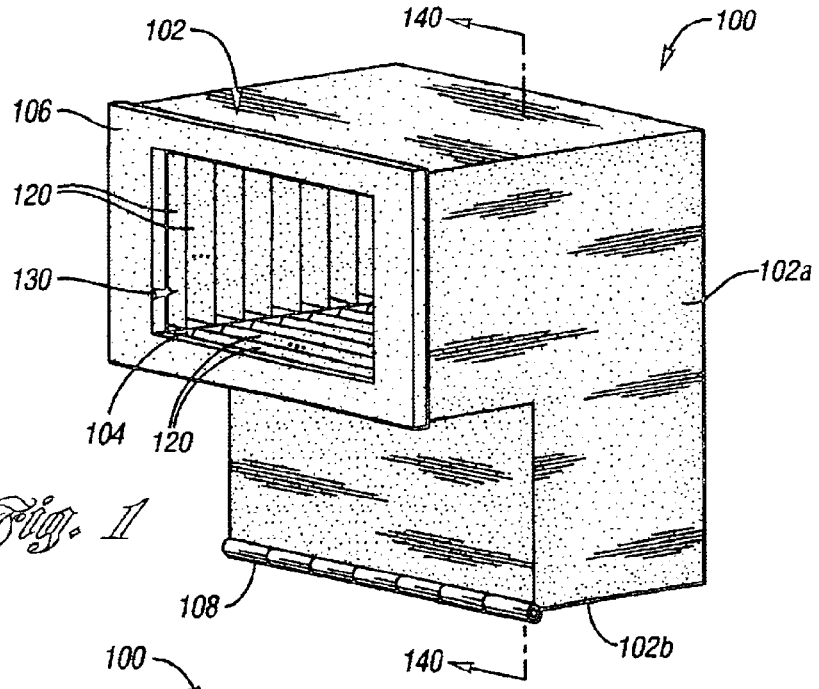
FIG. 1 is a diagram of a perspective view a cartridge casing catcher of the present invention.

Referring to FIG. 1, a diagram illustrating a system (i.e., apparatus, assembly, receptacle, etc.) 100 in accordance with a preferred embodiment of the present invention is shown. The apparatus 100 generally comprises a spent cartridge casing catcher (or brass catcher). The brass catcher 100 generally comprises a generally hollow housing (i.e., case, box, container, etc.) 102, a liner assembly 104, and a seal 106. In one example, the housing 102 may be implemented having walls configured as a box-on-box structure or shape (i.e., an upper box and a lower box) as illustrated.

The upper box is generally attached to a firearm (not shown) via an attachment mechanism (not shown) such that an opening 130 into the housing 102 communicates with the ejection port of the firearm and receives spent (or expended) cartridges (i.e., empty shells, casings, brass, etc.) as the shells are ejected from the firearm and the blast that is emitted from the ejection port when the firearm is discharged (i.e., when the firearm is fired). The lower box may comprise fixed walls 102*a*, a lid 102*b* having a hinge 108, and an opposing latch (not shown) that may provide for emptying spent cartridges from the catcher 100.

The housing 102 may be implemented having a structure similar to the container (10) disclosed in Kratzer '333. However, the housing 102 of the present invention is implemented without a perforated back wall (17) as disclosed in Kratzer '333 since such a perforated wall may provide a path for undesirable noise transmission. Further, the case 102 may be implemented having walls of any appropriate shape and configuration to meet the design criteria of a particular application. The housing 102 is generally produced (i.e., manufactured, built, made, implemented, etc.) using a substantially rigid material. Example materials for implementation of the case 102 may include steel, aluminum, rigid plastic, fiber-reinforced plastic, loaded (e.g., with a dense material such as lead, clay, or the like) plastic, and the like.

The liner 104 generally comprises a plurality of deflectors (i.e., fins, blades, wedges, etc.) 120 (described in more detail in connection with FIGS. 2 and 3). The liner 104 generally comprises an acoustic foam material that provides barrier and absorption (i.e., the physical process in which incident radiated energy is retained substantially without reflection or transmission) relative to the noise that is presented (i.e., discharged, radiated, emitted, etc.) from the ejection port of the firearm where the catcher 100 is implemented when the firearm is discharged, and damping to the walls of the housing 102.

The liner 104 acoustic foam is generally implemented as a partially-open cell foam having approximately (i.e., about, substantially, essentially, etc.) 85% cell reticulation (i.e., approximately 85% of the cells have walls that are opened via heat or chemical treatment during the production of the foam and approximately 15% of the cells remain closed). The liner 104 acoustic foam is generally implemented as a heat and chemical blast resistant material such as a urethane foam. However, the liner 104 may be implemented form a foam having any appropriate reticulation (e.g., 0% or closed cell foam to essentially 100% or open cell foam) and any appropriate material to meet the design criteria of a particular application. The liner 104 is generally fastened (e.g., fixed, adhered, etc.) to the inside of the container 102 via an appropriate adhesive, rivets, hook and loop, barbs on the inner wall of the housing 102, or any other appropriate fastening or adhering implementation to meet the design criteria of a particular application.

The acoustic foam liner 104 fixed to the inner surface of the case 102 generally forms a combination of acoustic barrier to noise generated by the blast emitted at the ejection port of the firearm when the firearm is discharged (i.e., the walls of the receptacle 100 may have a substantial noise transmission loss for the blast noise), absorption of the noise generated by the blast, and damping of the vibration generated by the impact of the casing 150 on the housing 102 (i.e., drumming) and deflection of the housing 102 generated by the blast (i.e., so-called "oil-canning"). The fins 120 generally reduce or eliminate tendencies of the casings 150 to move about and rattle in the housing 102 and the liner 104 absorbs noise made by rattling of the casings 150.

The seal 106 generally comprises a resilient, compliant material (e.g., vinyl, butyl, neoprene, etc. in a solid, gel-sac, closed-cell foam, skin covered foam, or other appropriate configuration). The seal 106 is generally fastened to the edge of the housing 102 and liner 104 that abut the ejection port region of the firearm. While the housing 102 and the seal 106 are shown having a substantially flat surface that contacts the firearm where the present invention is implemented, the housing 102 at the opening 130 and the seal 106 are generally shaped to substantially match an interfacing surface of the firearm where the catcher 100 is implemented. When the catcher 100 is mounted to the firearm, the seal 106 generally provides a substantial barrier to noise and flash (e.g., a substantially air-tight or hermetic seal) that is generated during the ejection of a spent cartridge. The seal 106 may be configured to provide a substantially air-tight path between the ejection port and the opening 130.

Figure 2:
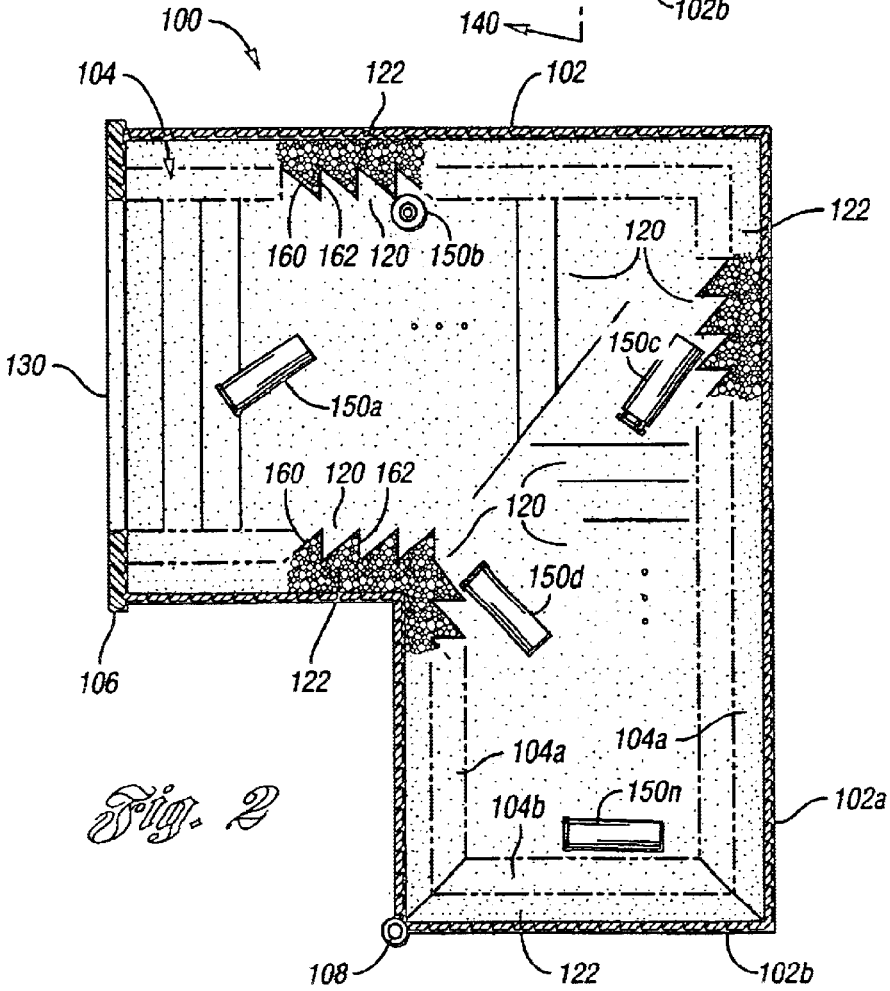
FIG. 2 is a diagram of a sectional view of the catcher of FIG. 1.

Referring to FIG. 2, a diagram illustrating a sectional view of the brass catcher 100 taken at the line 140—140 of FIG. 1 is shown. The liner 104 generally comprises the wedges 120 and a base portion (i.e., section, area, layer, etc.) 122. The wedges 120 are generally configured to deflect ejected casings 150 (e.g., casings 150*a*–150*n*) away from the opening 130 (i.e., away from the ejection port and into the lower box region of the housing 102 near the lid 102*b*). The fins 120 generally deflect either rimmed cartridges such as the casings 150*a* and 150*d* or rimless casings such as the casing 150*c*.

Each of the wedges 120 may have a face 160 that is oriented toward the opening 130 and a face 162 that is oriented away from the opening 130. The face 160 is generally slanted away from the opening 130 such that the casings 150 are deflected away from the opening 130 and generally toward the lid 102*b*. The face 162 is generally perpendicular the planar surface of the housing 102 or slanted away from the opening 130 such that the casings 150 are resisted from traveling (moving, bouncing, flying, etc.) back toward the opening 130 even when bouncing inside the housing 102.

Figure 3:
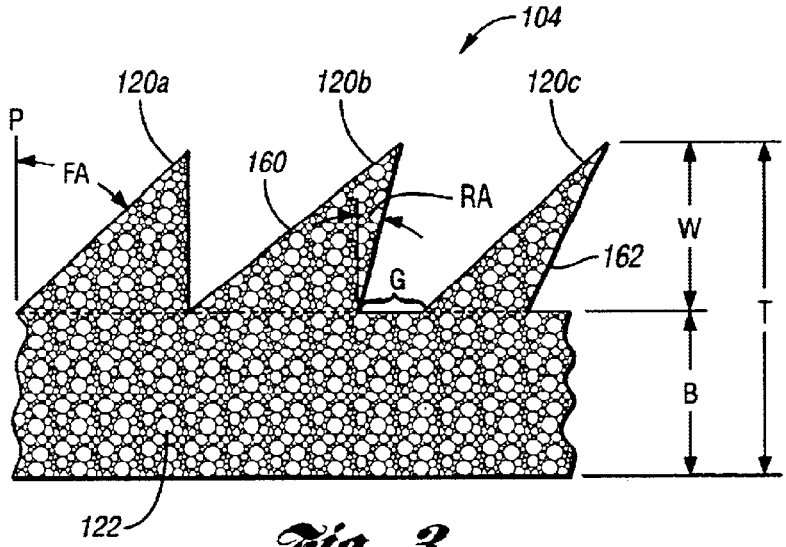
FIG. 3 is a diagram of alternative embodiments of the deflectors of the present invention.

Referring to FIG. 3, a diagram illustrating a sectional view of alternative embodiments of the deflectors 120 (e.g., deflectors 120*a*–120*c*) is shown. The liner 104 generally has a thickness (e.g., T). The thickness T generally comprises the sum of the thickness of the wedges 120 (e.g., W) and the base portion 122 (e.g., B). That is, T=W+B. The wedges 120 are generally of approximately (i.e., substantially, essentially, about, etc.) the same height (or thickness) W.

The wedge 120 height W is generally equal to or greater than the diameter of the cartridge casing 150 that is captured (or caught) by the brass catcher 100. The base 122 height B is generally approximately equal to the deflector 120 height W. However, the heights W and B may be implemented as any appropriate thickness to meet the design criteria of a particular application.

The front face 160 is generally at an angle (e.g., FA) relative to a line or plane (e.g., P) that is perpendicular to the surface of the region 122 that is fastened to the housing 102. The angle FA is generally in a range of 30 degrees to 75 degrees and preferably in a range of 45 degrees to 60 degrees. The rear face 162 is generally at an angle (e.g., RA) relative to line or plane P. The angle RA is generally in a range of 0 degrees to 35 degrees and preferably in a range of 0 degrees to 25 degrees. The angle RA is generally less than the angle FA. However, the angles FA and RA may be implemented at any appropriate angles to meet the design criteria of a particular application.

In one example, the fins 120 may be adjacent as illustrated by the fins 120*a* and 120*b*. In another example, the fins 120 may be separated by a gap (e.g., G) as illustrated by the fins 120*b* and 120*c*. The gap G is generally approximately equal to or less than the wedge height W.

Figure 4:
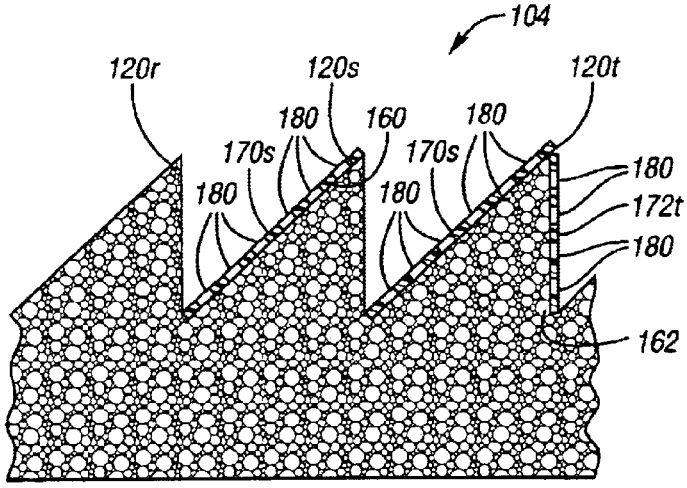
FIG. 4 is a diagram of alternative embodiments of the surfaces of the deflectors of the present invention.

Referring to FIG. 4, a diagram illustrating a sectional view of alternative embodiments of the surface treatment of the deflectors 120 (e.g., deflectors 120*r*–120*t*) is shown. In one example (e.g., wedge 120*r*), the foam that comprises the liner 104 may be uncovered. In another example (e.g., wedge 120*s*), the front surface 160 may be covered by a layer 170. In yet another example (e.g., wedge 120*t*), the front surface 160 may be covered by the layer 170 and the rear surface 162 may be covered by a layer 172. The layers 170 and 172 are generally implemented as a perforated material having a plurality of holes 180. The layers 170 and 172 are generally implemented from a material such as vinyl, butyl, neoprene, and the like. The layers 170 and 172 are generally implemented to reduce or eliminate degradation or erosion of the liner 104 due to the blast that is emitted from the ejection port and from the heat of the casings 150.

Figure 5:
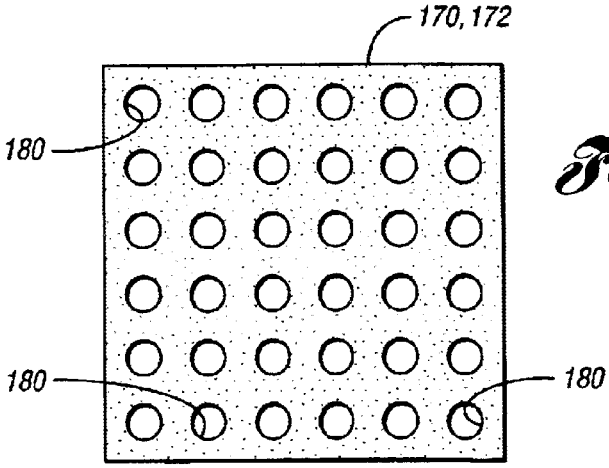
FIG. 5 is a diagram of a planar view of a surface of a facing of a deflector of the present invention.

Referring to FIG. 5, a diagram illustrating a plan view of the layers 170 and 172 is shown. The holes 180 generally comprise an area in a range of 30% to 90% of the total area of the layer 170 or 172 and preferably an area in a range of 50% to 75% of the total area of the layer 170 or 172. The holes 180 area generally sized and of sufficient total area to provide protection of the foam that comprises the liner 104 while providing reduction or elimination of degradation or erosion to the liner 104.

As is apparent then from the above detailed description, the present invention may provide an improved system and method for a cartridge casing catcher. Such an improved system and an improved method for a cartridge casing catcher may provide reduced or eliminated noise and flash from a firearm ejection port and so reduce or eliminate jamming caused by the spent cartridges bouncing back, reduced or eliminated rattle of collected brass, and reduced or eliminated bouncing of the spent cartridges back into the firearm ejection port when compared to conventional approaches.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A catcher for receiving expended shell casings from a firearm having an ejection port as the firearm is discharged, the catcher comprising:

a hollow housing having a plurality of rigid walls, wherein one of the walls has an opening in communication with the ejection port when the catcher is mounted to the firearm for receiving the shell casings; and a lining fixed inside the rigid walls, wherein the lining comprises an acoustic foam having a plurality of wedges and the wedges are configured to deflect the shell casings into the catcher, and each of the wedges has a front face that is slanted away from the opening such that the casings are deflected away from the opening and a rear face that is perpendicular to the planar surface of the housing or slanted away from the opening such that the casings are resisted from traveling back toward the opening even when bouncing inside the housing.

2. The catcher of claim 1 further comprising a seal attached to the housing at the opening, wherein the seal is configured to provide a substantially air-tight path between the ejection port and the opening.

3. The catcher of claim 1 wherein the acoustic foam is a partially-open cell foam having approximately 85% cell reticulation.

4. The catcher of claim 2 wherein the seal comprises a resilient, compliant material in a solid, gel-sac, closed-cell foam, or skin covered foam configuration.

5. The catcher of claim 1 wherein each of the wedges has a height that is equal to or greater than the diameter of the cartridge casing that is captured by the catcher.

6. The catcher of claim 1 wherein the wedges are adjacent or separated by a gap.

7. The catcher of claim 1 wherein the front surface of each of the wedges is covered by a layer of a perforated material.

8. The catcher of claim 1 wherein the front surface and the rear surface of each of the wedges is covered by a layer of a perforated material.

* * * * *